US007717745B2

(12) United States Patent
He et al.

(10) Patent No.: US 7,717,745 B2
(45) Date of Patent: May 18, 2010

(54) ELECTRICAL CONNECTOR WITH A TONGUE WITH TWO SETS OF CONTACTS

(75) Inventors: Jia-Yong He, Kunshan (CN); Qi-Sheng Zheng, Kunshan (CN); Hao Gu, Kunshan (CN)

(73) Assignee: Hon Hai Precision Ind. Co., Ltd, Taipei Hsien (TW)

( * ) Notice: Subject to any disclaimer, the term of this patent is extended or adjusted under 35 U.S.C. 154(b) by 0 days.

(21) Appl. No.: 12/384,862

(22) Filed: Apr. 9, 2009

(65) Prior Publication Data

US 2009/0258528 A1 Oct. 15, 2009

(30) Foreign Application Priority Data

Apr. 9, 2008 (CN) ..... 2008 2 0035063 U

(51) Int. Cl.
*H01R 13/648* (2006.01)

(52) U.S. Cl. ..... 439/607.23

(58) Field of Classification Search ..... 439/607.23, 439/607.37, 607.4, 79, 541.5
See application file for complete search history.

(56) References Cited

U.S. PATENT DOCUMENTS

| | | | | |
|---|---|---|---|---|
| 6,309,227 | B1 * | 10/2001 | Chen et al. | 439/79 |
| 6,364,708 | B1 * | 4/2002 | Chen et al. | 439/607.37 |
| 6,383,024 | B1 * | 5/2002 | Wang et al. | 439/607.23 |
| 6,416,359 | B1 * | 7/2002 | Zhang et al. | 439/607.37 |
| 6,475,034 | B1 * | 11/2002 | Zhang et al. | 439/607.4 |
| 6,554,648 | B2 * | 4/2003 | Shi et al. | 439/607.55 |

* cited by examiner

*Primary Examiner*—Chandrika Prasad
(74) *Attorney, Agent, or Firm*—Wei Te Chung; Andrew C. Cheng; Ming Chieh Chang

(57) ABSTRACT

An electrical connector (100) includes an insulative housing (1), a plurality of contacts (2) retained in the insulative housing (1) and a metal shell (3). The insulative housing (1) has a base portion (111). The base portion (111) has a front face (112), a top face (113) and a mounting face (114) opposite to the top face (113). The insulative housing (1) has a tongue (115) extending forwardly from the front face (112). The tongue (115) has a left face (1151) and a right face (1152). The metal shell (3) comprises a left wall (34) and a right wall (35). Each contact (2) has a contact portion (211, 221) extending to the left face (1151) of the tongue (115). The space between the left face (1151) and the left wall (34) is larger than that between the right face (1152) and the right wall (35).

12 Claims, 9 Drawing Sheets

ELECTRICAL CONNECTOR WITH A TONGUE WITH TWO SETS OF CONTACTS

BACKGROUND OF THE INVENTION

1. Field of the Invention

The present invention relates to an electrical connector, and more particularly to electrical connectors with a tongue.

2. Description of Related Art

Universal Serial Bus (USB) is used widely in variety electronic devices as a standard and simple interface. The standard USB 2.0 receptacle comprises an insulative housing, a plurality of contacts received in the insulative housing and a metal shell covering the insulative housing. The insulative housing has a base and a tongue extending levelly and forwardly from the base. The metal shell has a top wall and a bottom wall which are parallel to the tongue. The space between an upper face of the tongue and the top wall is smaller than that between a lower face of the tongue and the bottom wall. Each contact has a contact portion extending to the lower face of the tongue.

As a miniaturized development of electronic industry, the standard USB 2.0 can not satisfied the requirement of many electric devices because of a large mounting space thereof. For adapting to the miniaturized development of electric industry, another type of USB receptacle which we said upright USB receptacle is born. The upright USB receptacle stands up from a right side of the standard USB receptacle for decreasing the mounting face thereof. A tongue of the upright USB receptacle extends uprightly. A metal shell of the upright USB receptacle has a left wall and a right wall which are parallel to the tongue. The space between a left face of the tongue and the left wall is smaller than that between a right face of the tongue and the right wall. Each contact of the upright USB receptacle has a contact portion extending to the right face of the tongue.

However, whether standard USB receptacle or upright USB receptacle, there are many consumers can not use these normal USB interfaces conveniently and usually insert a corresponding plug conversely which destroys the USB receptacle easily.

Hence, another type USB receptacle is desired to overcome the disadvantage of the prior art.

BRIEF SUMMARY OF THE INVENTION

According to the present invention, an electrical connector comprises: an insulative housing comprising a base portion, the base portion having a front face, a top face and a mounting face opposite to the top face, the insulative housing having a tongue extending forwardly from the front face, the tongue having a left face and a right face; a metal shell covering the insulative housing and defining a receiving space with the insulative housing, the metal shell comprising a left wall and a right wall; and a plurality of contacts retained in the insulative housing, each contact having a contact portion extending to the left face of the tongue and a soldering portion extending out of the mounting face. The space between the left face and the left wall is larger than that between the right face and the right wall.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENT

Figure 1:
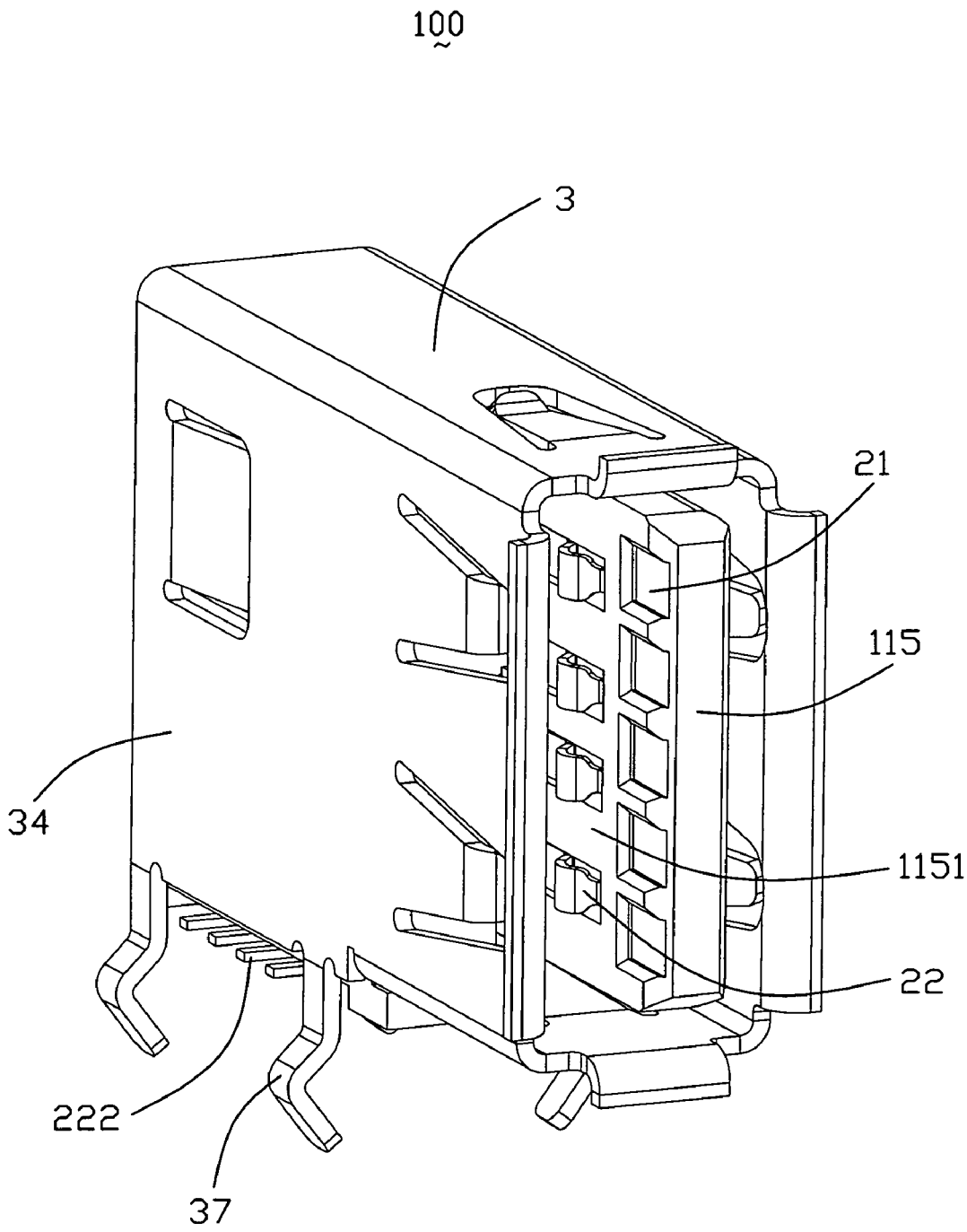
FIG. 1 is a perspective view of an electrical connector according to a first embodiment of the present invention.
Figure 2:
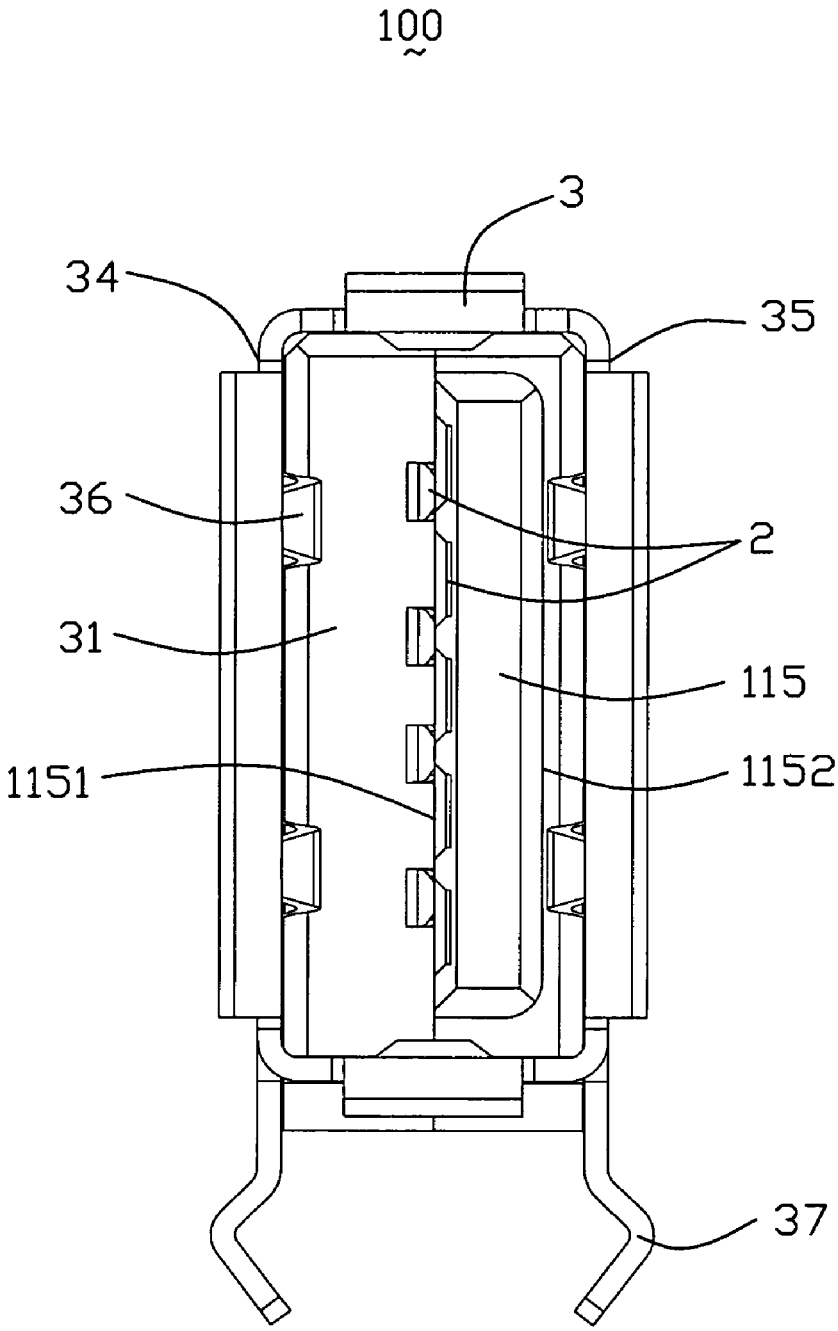
FIG. 2 is a front view of the electrical connector shown in FIG. 1.
Figure 3:
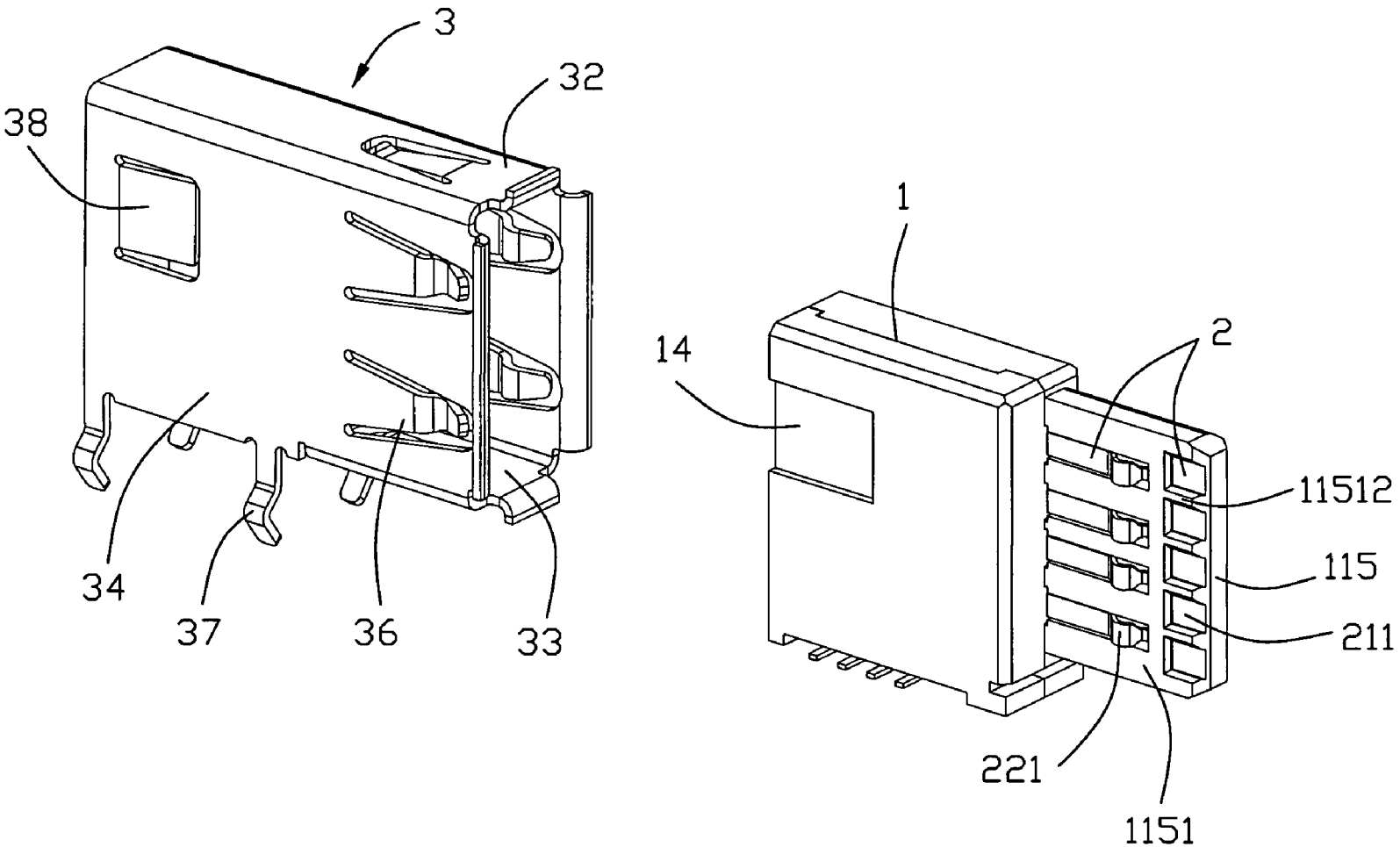
FIG. 3 is a partial exploded view of the electrical connector shown in FIG.
Figure 4:
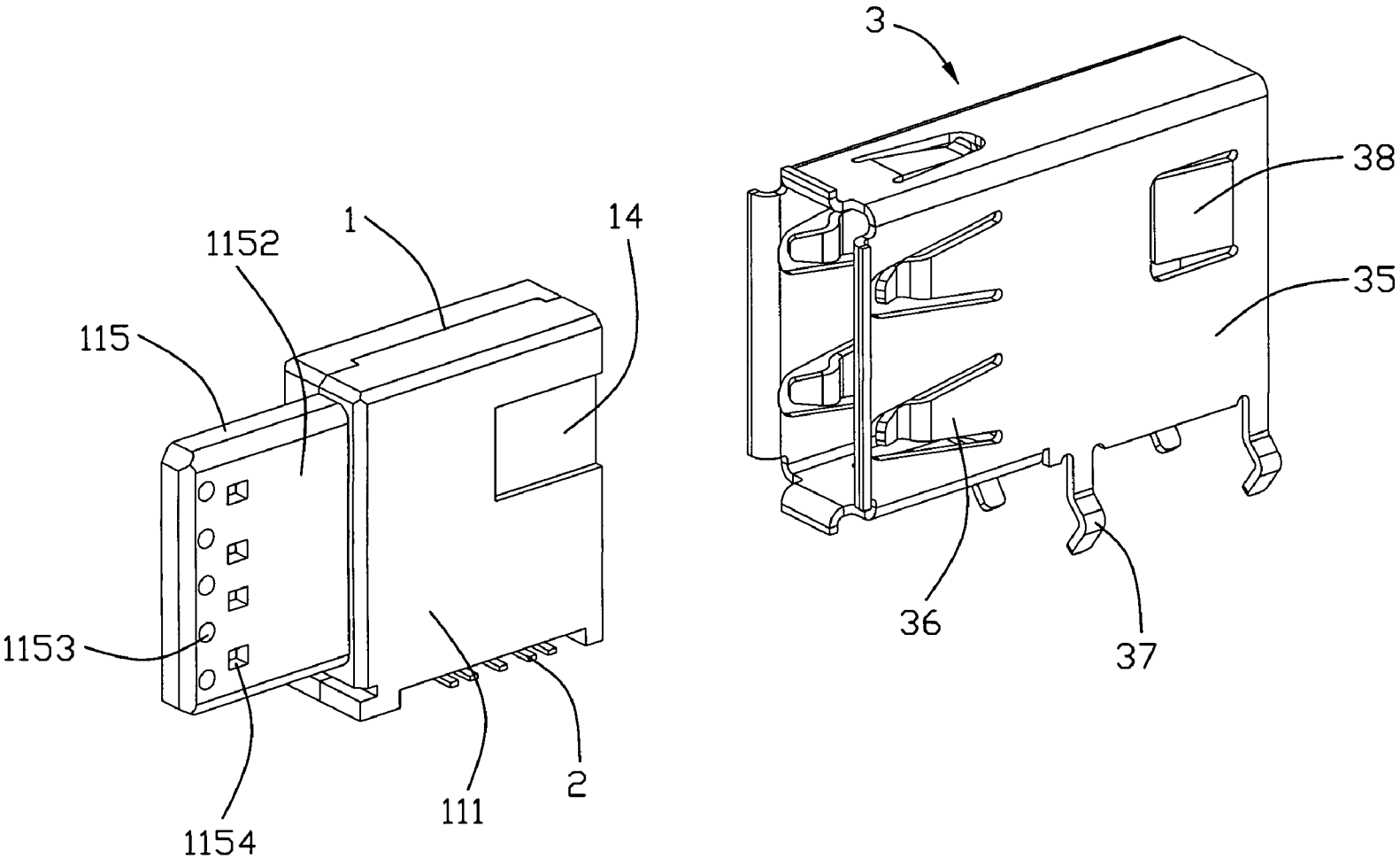
FIG. 4 is a view similar to FIG. 3, while taken from another aspect.
Figure 5:
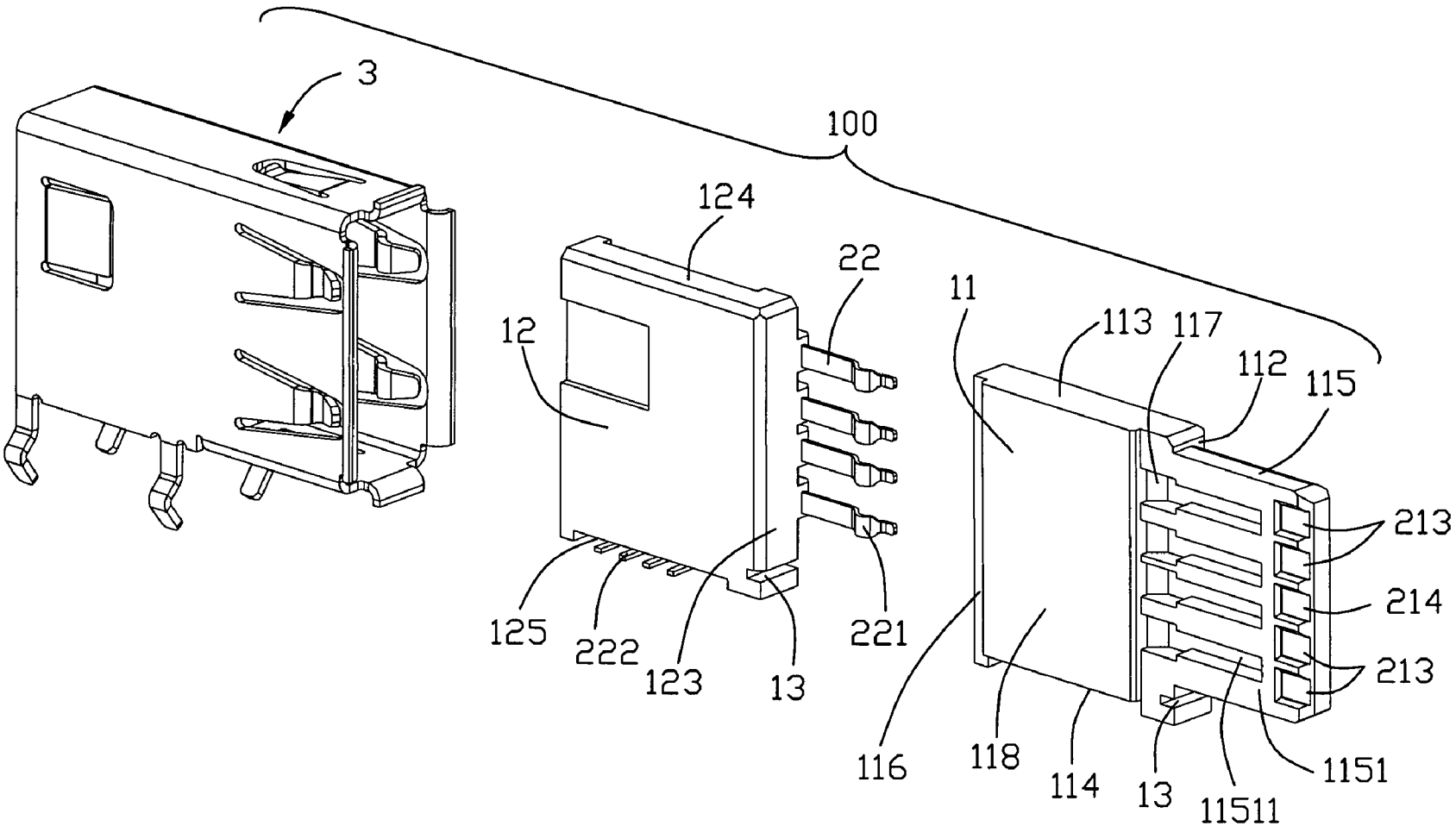
FIG. 5 is an exploded view of the electrical connector shown in FIG. 1.
Figure 6:
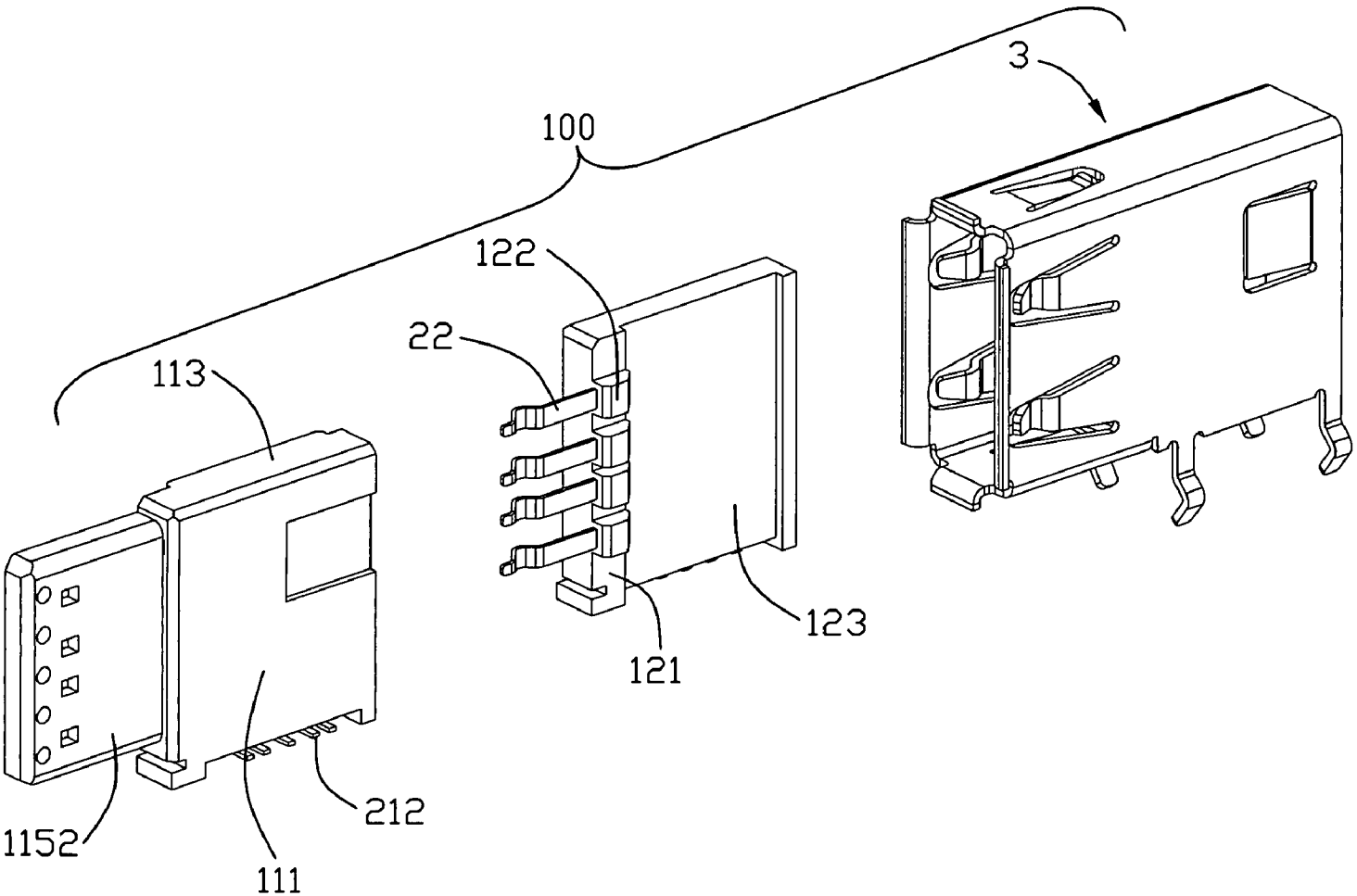
FIG. 6 is a view similar to FIG. 5, while taken from another aspect.

In the following description, numerous specific details are set forth to provide a thorough understanding of the present invention. However, it will be obvious to those skilled in the art that the present invention may be practiced without such specific details. In other instances, well-known circuits have been shown in block diagram form in order not to obscure the present invention in unnecessary detail. For the most part, details concerning timing considerations and the like have been omitted inasmuch as such details are not necessary to obtain a complete understanding of the present invention and are within the skills of persons of ordinary skill in the relevant art.

Referring to FIGS. 1-6, an electrical connector 100 according to a first embodiment of the present invention is disclosed. The electrical connector 100 comprises an insulative housing 1, a plurality of contacts 2 retained in the insulative housing 1, and a metal shell 3 covering the insulative housing 1.

Referring to FIGS. 3-6, the insulative housing 1 comprises a first housing 11 and a second housing 12 engaging with each other. The contacts 2 comprise a plurality of first contacts 21 insert molded in the first housing 11 and a plurality of second contacts 22 insert molded in the second housing 12. The first housing 11 has a base portion 111. The base portion 111 has a front face 112, a top face 113 and a mounting face 114 opposite to the top face 113. The base portion 111 has an inner wall 116 with a plurality of installed grooves 117 and a block 118 at a rear position of the installed grooves 117 and projecting out of the inner wall 116 for engaging with the second housing 12. The first housing 11 has a tongue 115 extending forwardly from the front face 112. The tongue 115 is perpendicular to the mounting face 114. A geometric profile of the tongue 115 is substantially same as that of a standard USB 2.0 A type receptacle. The metal shell 3 surrounds the tongue 115 and forms a receiving space 31 with the tongue 115 for receiving a corresponding plug (not shown). The receiving space 31 opens sideward. The tongue 115 has a left face 1151 and a right face 1152 which are perpendicular to the top face 113 and the mounting face 114.

Each first contact 21 has a first contact portion 211 extending to a front end of the tongue 115 and a first soldering portion 212 extending out of the mounting face 114 of the insulative housing 1. The first contact portions 211 are flat and arranged in a row along a length direction of the tongue 115. The first contact portions 211 are partially exposed to the receiving space 31 but not extend out of the left face 1151. The first soldering portions 212 extend sideward and parallel to the mounting face 114.

The tongue 115 has a plurality of ribs 11512 between adjacent first contact portions 211 to separate the first contact portions 211 with each other, and a plurality of receiving slots 11511 at a rear position of the first contact portions 211 to receive the second contact portions 22. The tongue 115 is formed with a plurality of position holes 1153 corresponding to the first contact portions 211 and a number of depressions 1154 located at a rear position of the position holes 1153 and between adjacent first contacts 21. A mold (not shown) used for molding the first housing 1 has a plurality of small posts at the position of position holes 1153 for positioning the first contacts 21, and a number of pins at the position of depressions 1154 for preventing the adjacent first contacts 21 from contacting with each other.

The second housing 12 is a rectangular insulator and has a mating wall 121 for engaging with the inner wall 116 of the first housing 11. The mating wall 121 has a plurality of protrusions 122 and an installed slot 126 adjacent to the protrusions 122. The protrusions 122 engage with the installed grooves 117, and the block 118 engages with the installed slot 126 for fixing the first and second housing 11, 12 together. Therefore, the second housing 12 is arranged at a side portion of the tongue 115 along a width direction of the first housing 11 and located at a rear portion of the tongue 115 along a length direction of the first housing 11. The second housing 12 has a front face 123, a top face 124 and a mounting face 125 also. Each second contact 22 has a second contact portion 221 extending out of the front face 123, and a second soldering portion 222 extending out of the mounting face 125. The second soldering portions 222 are parallel to the mounting face 114, 125, and extend sideward and opposite to the first soldering portions 212. The first and second housing 11, 12 each defines a cutout 13 recessed from a lower portion of the front faces 112, 123 and communicating with each other for positioning the metal shell 3. Each outside wall of the first and second housing 11, 12 defines a recess 14 for engaging with the metal shell 3.

Referring to FIGS. 1-4, when the second housing 12 with the second contacts 22 is assembled to the first housing 11 with the first contacts 21, the second contact portion 221 is elastic and cantileveredly received in the receiving slots 11511, and the second contact portion 221 is disposed above the left face 1151 and extends into the receiving space 31. Therefore, the flat first contact portions 211 and the elastic second contact portions 221 are located at different plane along a thickness direction of the tongue 115 for assuring signal transmit steadily. The second contact portions 221 are arranged in a row along the length direction of the tongue 115 too. The first contact portion 211 and the second contact portion 221 are arranged at a same side of the tongue 115 along the thickness direction of the tongue 115. The first contact portions 211 are located at a front side of the second contact portions 221 and spaced apart from the second contact portions 221 along the length direction, for preventing the first and second contact portions 211, 221 crosstalk with each other when they are arranged in a same row.

The second contacts 22 are adapted for USB protocol and transmit signals same to the standard USB 2.0 receptacle. The second contacts 22 comprise four contacts which are a power contact, a pair of differential signal contacts and a ground contact. The differential signal contacts are located between the power contact and the ground contact. Thereby, the electrical connector 100 in the present invention can mate with a normal USB 2.0 plug (not shown). The first contacts 21 comprise two pairs of differential signal contacts for transmitting high frequency signals and a ground contact between two pairs of differential signal contacts. Of course, the first contacts 21 could comprise only a pair of or many pairs of differential signal contacts and ground contact 214 in the other embodiment.

The metal shell 3 covers the insulative housing 1 and fixes the first and second housing 11, 12 together. The metal shell 3 has an upper wall 32, a lower wall 33 opposed to the upper wall 32, a left wall 34 and a right wall 35 opposed to the left wall 34. A rear end of the lower wall 33 is positioned in the cutout 13 of the insulative housing 1. The upper wall 32, lower wall 33, left wall 34 and right wall 35 each has at least a spring arm 36 extending into the receiving space 31. The electrical connector 100 defines a first space between the left face 1151 and the left wall 34 and a second space between the right face 1152 and the right wall 35. The first face is larger than the second face. The metal shell 3 has two pairs of mounting legs 37 extending downwardly from the left and right wall 34, 35 respectively for mounting the electrical connector 100 to a circuit board (not shown). The left wall 34 and right wall 35 each has a spring tab 38 extending inwardly for resisting to the recesses 14 of the first and second housing 11, 12.

Figure 7:
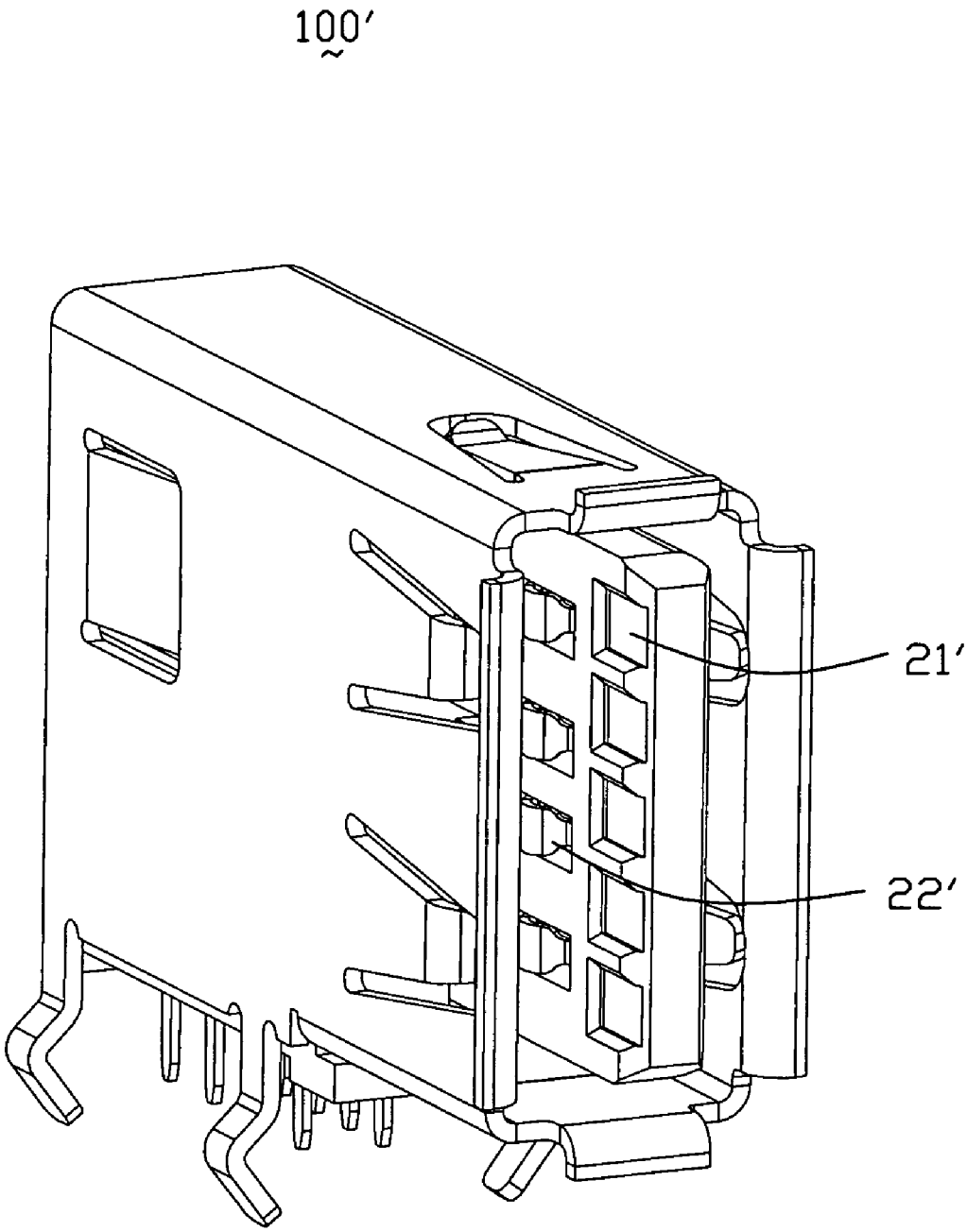
FIG. 7 is a perspective view of an electrical connector according to a second embodiment of the present invention.
Figure 8:
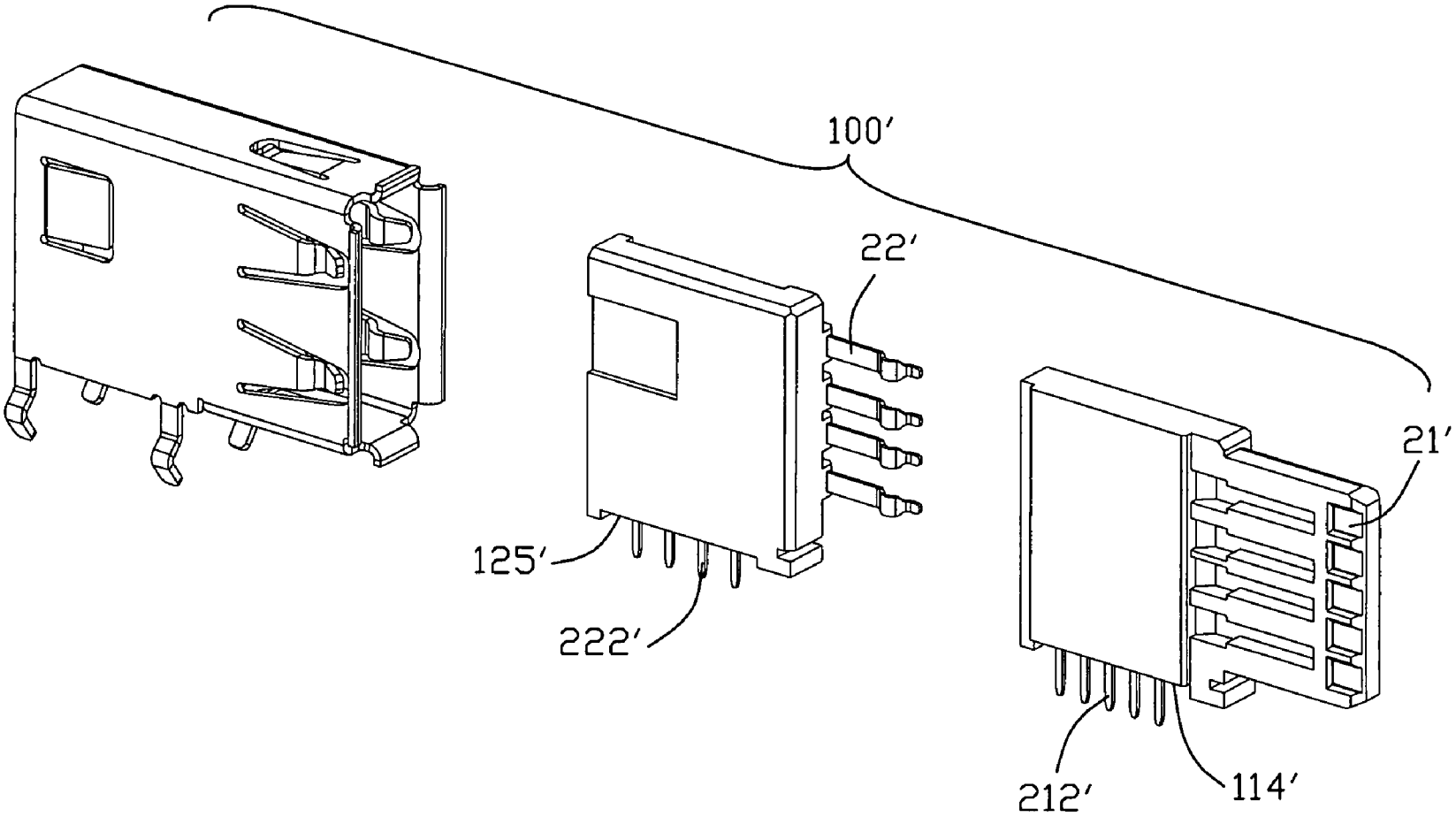
FIG. 8 is an exploded view of the electrical connector shown in FIG. 7.
Figure 9:
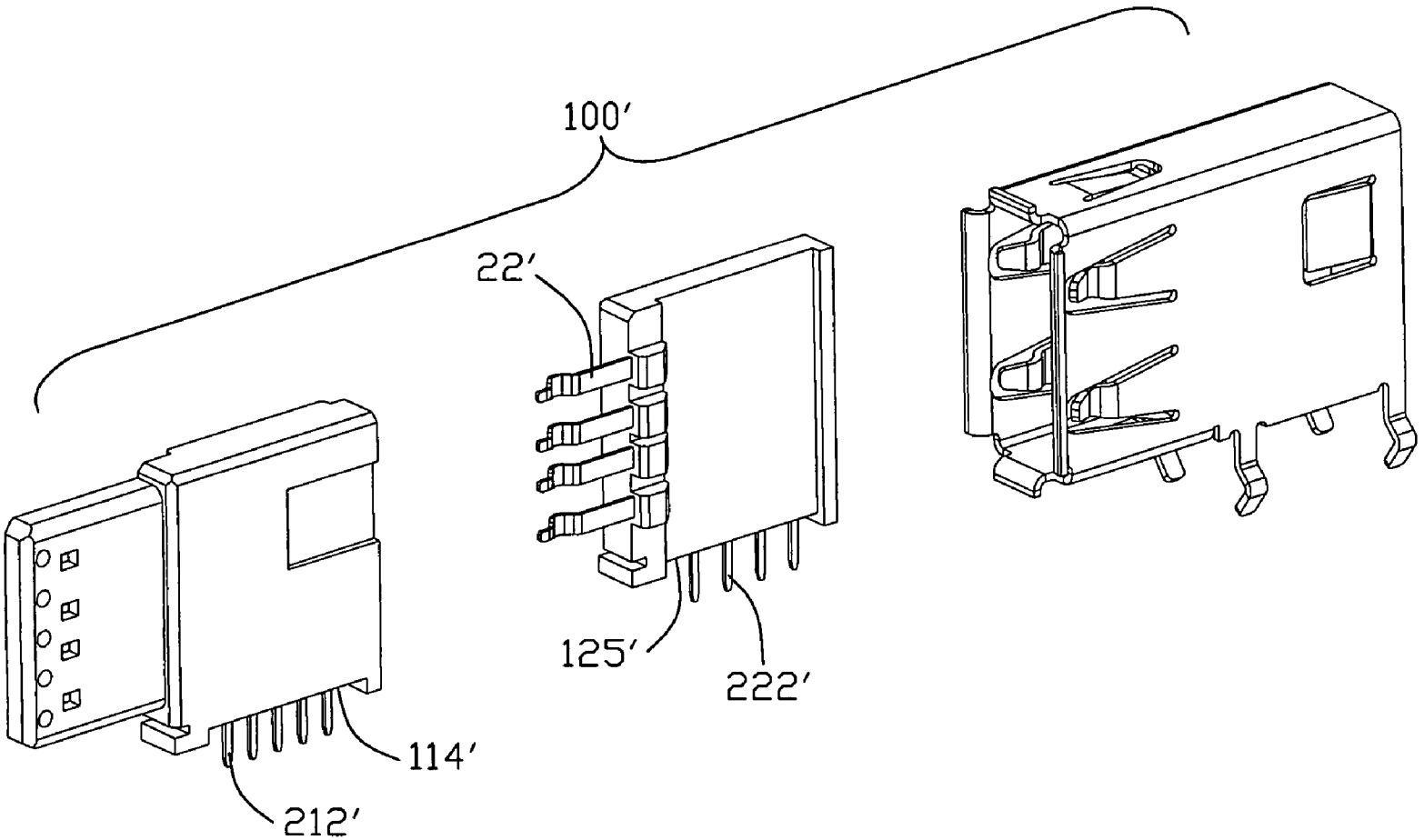
FIG. 9 is a view similar to FIG. 8, while taken from another aspect.

Referring to FIGS. 7-9, an electrical connector 100' according to a second embodiment of the present invention is disclosed. Structures of the electrical connectors 100, 100' in the first and second embodiments is similar, and a small difference is that: the first and second soldering portions 212', 222' of the first and second contacts 21', 22' extend downwardly and perpendicular to the mounting face 114', 125' for through hole mounting purpose. The electrical connector 100' of the second embodiment can achieve the purpose of the present invention also.

As fully described above, the contact portions 211, 221, 211' and 221' are arranged in the left face 1151 of the tongue 115. The tongue 115 extends forwardly and perpendicular to the mounting face 114, 125, 114' and 125', therefore, the electrical connector 100, 100' not only has a small mounting face 114, 125, 114' and 125' for adapting to the miniaturived development of the electrical industry, but also supplies another type of mating manner for different consumers. In addition, the electrical connector 100, 100' is adapted for USB protocol and can mate the USB 2.0 plug. Finally, the electrical connector 100, 100' adds a plurality of first contacts 21, 21' for transmitting high frequency signals than the standard USB receptacle, therefore, the transmission speed of the electrical connector 100, 100' is increased.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. An electrical connector comprising:

an insulative housing comprising a base portion, the base portion having a front face, a top face and a mounting face opposite to the top face, the insulative housing having a tongue extending forwardly from the front face, the tongue having a left face and a right face;

a metal shell covering the insulative housing and defining a receiving space with the insulative housing, the metal shell comprising a left wall and a right wall; and a plurality of contacts retained in the insulative housing, each contact having a contact portion extending to the left face of the tongue and a soldering portion extending out of the mounting face;

wherein the space between the left face and the left wall is larger than that between the right face and the right wall: Wherein the contacts comprise a plurality of first contacts with first contact portions and a plurality of second contact with second contact portions, wherein the first and second contact portions are spaced apart and arranged in two rows along a lengthwise direction of the tongue, Wherein the insulative housing comprises a first housing insert molded around the first contacts and a second housing insert molded around the second contacts, and the first housing has a plurality of grooves recessed from an inner wall to engage a plurality of protrusions on the second housing.

2. The electrical connector according to claim 1, wherein a geometric profile of the tongue is substantially same as what of a standard USB 2.0 A type receptacle.

3. The electrical connector according to claim 2, wherein the tongue is perpendicular to the mounting face, and the receiving space opens sideward.

4. The electrical connector according to claim 3, wherein the first contact portions are flat and extend to a front end of the tongue, and the second contact portions are elastic and cantileveredly extend out of the left face.

5. The electrical connector according to claim 1, wherein the first contacts comprise at least a pair of differential contacts for transmitting high frequency signals, and the second contacts are adapted for USB protocol and transmit USB 2.0 signals.

6. The electrical connector according to claim 3, wherein the second housing is arranged at a side portion of the tongue along a width direction of the first housing and located at a rear portion of the tongue along a length direction of the first housing.

7. The electrical connector according to claim 6, wherein the first housing has a block at a rear position of the installed grooves and projecting out of the inner wall, and the second housing defines an installed slot to engage with the block.

8. The electrical connector according to claim 3, wherein the tongue has a plurality of ribs between adjacent first contact portions to separate the first contact portions with each other, and a plurality of receiving slots at a rear position of the first contact portions to receive the second contact portions.

9. The electrical connector according to claim 3, wherein the tongue is formed with a plurality of position holes corresponding to each first contact portion to position the first contacts and a plurality of depressions between adjacent first contacts to prevent the adjacent first contacts from contacting with each other.

10. The electrical connector according to claim 1, wherein the metal shell has a plurality of flanges extending outwardly from a front end thereof.

11. An electrical connector comprising:

a first insulative unit defining a mating tongue with opposite first and second faces thereof, a plurality of passageways formed in the first face;

a plurality of first contacts disposed in the first unit, each of the first contacts defining a planar un-deflectable contacting section exposed upon a front portion of the first face;

a second insulative unit;

a plurality of second contacts disposed in the second unit with a curved deflectable contacting portion extending forward beyond the second unit and extending into the corresponding passageway with a contact point region exposed outside of the mating tongue away from the first face; wherein the second unit defines a plurality of protrusions received in the corresponding passageways, respectively, so as to assure the corresponding second contacts are received in the corresponding passageways, respectively.

12. The electrical connector as claimed in claim 11, wherein said second contacts are insert molded in the second unit.

* * * * *